US008029964B1

(12) United States Patent
Almanza-Workman et al.

(10) Patent No.: US 8,029,964 B1
(45) **Date of Patent: *Oct. 4, 2011**

(54) POLYMER-BASED PATTERN MASK SYSTEM AND METHOD HAVING ENHANCED ADHESION

(75) Inventors: A. Marcia Almanza-Workman, Sunnyvale, CA (US); Carl P. Taussig, Redwood City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1056 days.

This patent is subject to a terminal disclaimer.

(21) Appl. No.: 11/781,205

(22) Filed: Jul. 20, 2007

(51) Int. Cl.
*G03G 5/00* (2006.01)

(52) U.S. Cl. .... 430/117.1; 430/5; 430/117.3; 430/119.6

(58) Field of Classification Search ..... 430/5, 32, 430/117.3, 119.6, 117.1
See application file for complete search history.

(56) References Cited

U.S. PATENT DOCUMENTS

| | | | | |
|---|---|---|---|---|
| 4,389,432 | A * | 6/1983 | Inoue et al. | 427/299 |
| 5,319,400 | A | 6/1994 | Herbert et al. | |
| 6,017,665 | A | 1/2000 | Grune et al. | |
| 6,080,606 | A | 6/2000 | Gleskova et al. | |
| 6,162,570 | A | 12/2000 | Maess et al. | |
| 6,709,962 | B2 | 3/2004 | Berg | |
| 6,742,884 | B2 | 6/2004 | Wong et al. | |
| 6,746,946 | B2 | 6/2004 | Berg | |
| 6,849,308 | B1 | 2/2005 | Speakman et al. | |
| 6,872,320 | B2 | 3/2005 | Wong et al. | |
| 6,921,618 | B2 | 7/2005 | Hongo et al. | |
| 6,936,181 | B2 | 8/2005 | Bulthaup et al. | |
| 6,957,608 | B1 | 10/2005 | Hubert et al. | |
| 7,078,141 | B2 | 7/2006 | Ben-Avraham et al. | |
| 2002/0092825 | A1 | 7/2002 | Schneider et al. | |
| 2004/0092337 | A1 | 5/2004 | Tzivanis et al. | |
| 2005/0263903 | A1 | 12/2005 | Forbes et al. | |
| 2006/0112858 | A1 | 6/2006 | Nguyen | |

FOREIGN PATENT DOCUMENTS

| | | | |
|---|---|---|---|
| JP | 10207130 | * | 8/1998 |

OTHER PUBLICATIONS

Author Unknown, "A closer look: white paper—digital offset color", Copyright Hewlett-Packard Company 2002.

K. Biswas et al., "Bulk micromachining of silicon in TMAH-based etchants for aluminum passivation and smooth surface", Microelectronics Journal, vol. 37, 2006, pp. 321-327.

Udi Chatow and Ronen Samuel, "Digital Labels Printing", IS&T NIP19: 2003 International Conference on Digital Printing Technologies, pp. 476-481.

Barry Arkles, "Silane Coupling Agents: Connecting Across Boundaries v2.0" Catalog, 2006, pp. 1-60, Gelest, Inc., Morrisville, PA.

* cited by examiner

*Primary Examiner* — Thorl Chea

(57) ABSTRACT

A polymer-based pattern mask system and methods of masking and patterning a substrate employ an organosilane to enhance adhesion between a pattern mask and the substrate. The substrate is compatible with the organosilane. The methods include applying a coating of the organosilane to a substrate surface and printing a pattern mask on the coated surface using a roll-to-roll printing process. The pattern mask is polymer-based. The organosilane enhances adhesion during printing of the pattern mask. The method of patterning further includes patterning the substrate surface and lifting-off the pattern mask. The organosilane further enhances adhesion during patterning and does not hinder lifting-off the pattern mask. The system includes the pattern mask, the organosilane and a lift-off agent to remove the pattern mask.

20 Claims, 2 Drawing Sheets

POLYMER-BASED PATTERN MASK SYSTEM AND METHOD HAVING ENHANCED ADHESION

CROSS-REFERENCE TO RELATED APPLICATIONS

N/A

STATEMENT REGARDING FEDERALLY SPONSORED RESEARCH OR DEVELOPMENT

N/A

BACKGROUND

1. Technical Field

The invention relates to circuit fabrication. In particular, the invention relates to enhancing adhesion between a polymer-based etch mask and a substrate using an organosilane.

2. Description of Related Art

For much of the history of modern electronics, optical lithography has been the principal means of patterning substrates in the fabrication of printed circuits, semiconductors, and related structures. In optical lithography, a photoresist is deposited onto a surface of a substrate being patterned. A source of radiation (e.g., ultraviolet light, electron beam, etc.) is then employed to differentially expose the photoresist and impart a pattern thereto. For example, the photoresist may be exposed to ultraviolet light projected through a photomask such that a pattern of the photomask is transferred to the photoresist. The photoresist bearing the transferred pattern forms a pattern mask that protects specific portions of the substrate that are covered by the pattern mask. Various techniques such as pattern etching and pattern lift-off are then employed to transfer the pattern of the photoresist pattern mask to a surface of the substrate.

Relatively recently, other methods of creating a pattern mask for substrate patterning have been proposed and, in some cases, have begun to gain acceptance as viable alternatives to photolithography. Among these techniques are imprint lithography and digital resist printing. In imprint lithography, a pattern mold is employed to mechanically imprint a pattern into a relatively soft resist material on a surface of the substrate. The imprinted soft resist material is then employed as a mask in a manner similar to the photoresist pattern mask.

In digital resist printing, a pattern mask is printed directly onto the substrate using a digital printer or equivalent. For example, an inkjet printer may be employed to print a liquid resist onto a substrate in a manner similar to that used to print an image onto a piece of paper. The inkjet printer essentially applies the liquid resist as a series of directed droplets that combine to form the pattern mask. In another example, a laser printer is employed to directly print the pattern mask onto the substrate. The laser printer employs a dry toner comprising a fine powder that is electrostatically guided and imaged onto the substrate under digital control of the printer. After being imaged, particles of the dry toner are fused together on the substrate to form the pattern mask. Either of the inkjet printer-applied liquid resist or the laser printer-applied dry toner produces a pattern mask that may be employed in a manner similar to the photoresist pattern mask to pattern the substrate.

Advantageously, digital resist printing does not depend on the creation and use of either a photomask or a mold. As such, the mask pattern can be readily changed or adjusted during substrate patterning. However, inkjet-based resist printing is relatively slow. Thus, inkjet-based resist printing may be of limited use, especially for high speed and/or high volume printed circuit production (e.g., roll-to-roll processing). The use of laser printers for direct printing of a dry toner-based pattern mask can support high speed, high volume production. However, the dry toner employed by laser printers severely limits an ultimate resolution of the pattern and further suffers from problems of line edge fidelity and unwanted background printing caused by powder dispersion during printing.

BRIEF SUMMARY

In some embodiments of the present invention, a method of masking a substrate is provided. The method of masking a substrate comprises applying a coating of an organosilane to a surface of a substrate to be patterned; and printing a pattern mask on the coated substrate using liquid electrophotographic (LEP) printing. The substrate surface comprises a material compatible with the organosilane. The pattern mask comprises a fused liquid toner, wherein the liquid toner comprises toner particles dispersed in a carrier liquid; and the toner particles comprise a polymer resin. The organosilane enhances adhesion between the substrate surface and the pattern mask during LEP printing.

In other embodiments of the present invention, a method of patterning a substrate is provided. The method of patterning a substrate comprises applying a coating of an organosilane to a surface of a substrate to be patterned; and printing a pattern mask on the coated substrate surface using a roll-to-roll printing process. The substrate surface comprises a material compatible with the organosilane. The pattern mask is polymer-based. The organosilane forms a bond between the pattern mask and the substrate surface. The method of patterning a substrate further comprises patterning the substrate surface using the pattern mask; and lifting-off the pattern mask from the patterned substrate surface. The organosilane enhances adhesion between the substrate surface and the pattern mask during printing and patterning, and lifting-off the pattern mask is unhindered by the organosilane.

In other embodiments of the present invention, a polymer-based pattern mask system is provided. The polymer-based pattern mask system comprises a polymer-based liquid toner. The liquid toner acts as a pattern mask when printed on a substrate. The pattern mask is employed in patterning a surface of the substrate. The polymer-based pattern mask system further comprises an organosilane. The organosilane is coated on the surface of the substrate. The substrate surface to be patterned comprises a material compatible to the organosilane. The organosilane coating enhances adhesion between the pattern mask and the substrate surface. The polymer-based pattern mask system further comprises a lift-off agent. The lift-off agent degrades a bond between the substrate and the pattern mask to facilitate removal of the pattern mask following substrate patterning. The organosilane coating enhances adhesion during patterning of the substrate, while removal of the pattern mask is unhindered by the organosilane coating.

Certain embodiments of the present invention have other features that may be one or both of in addition to and in lieu of the features described hereinabove. These and other features of the invention are detailed below with reference to the following drawings.

BRIEF DESCRIPTION OF THE DRAWINGS

The various features of embodiments of the present invention may be more readily understood with reference to the following detailed description taken in conjunction with the accompanying drawings, where like reference numerals designate like structural elements, and in which.

DETAILED DESCRIPTION

Figure 1:
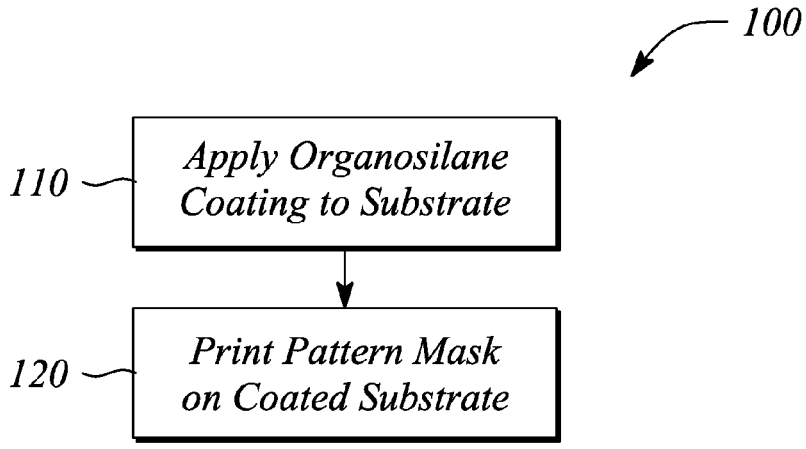
FIG. 1 illustrates a flow chart of a method of masking a substrate according to an embodiment of the present invention.

Embodiments of the present invention facilitate masking and subsequently patterning a substrate using an adhesion enhancer between a pattern mask and the substrate to be patterned. Embodiments of the present invention employ an organosilane adhesion enhancer on the substrate. The adhesion enhancer interacts with both the substrate surface and the pattern mask that is subsequently printed on the substrate. The adhesion enhancer facilitates the adhesion of the pattern mask to the substrate during both mask printing and substrate patterning but does not interfere with patterning or mask removal. Embodiments of the present invention may be used for printed flexible circuit fabrication using roll-to-roll printing systems, for example large area flexible circuit fabrication.

The pattern mask is a polymer-based pattern mask that is printed on the substrate, for example, using a liquid electrophotographic (LEP) printing process that employs a roll-to-roll printing system. The pattern mask is employed in patterning the substrate, thereby obviating a need for a photomask and another masking material (e.g., photoresist). The organosilane adhesion enhancer is a functionalized coating having a low molecular weight that facilitates application in a very thin layer, typically one or more molecular layers (e.g., measured in angstroms). The adhesion enhancer is applied to a surface of the substrate in the very thin layer or coating using a deposition process compatible with roll-to-roll printing processes. The organosilane adhesion enhancer provides improved adhesion between the pattern mask and the substrate surface using increased hydrogen bonding provided by functional groups of the organosilane. In some embodiments, adhesion between the pattern mask and the substrate is enhanced using a combination of hydrogen bonding, acid-base bonding and covalent bonding provided by the functional groups of the organosilane adhesion enhancer.

The organosilane adhesion enhancer coating on the substrate facilitates adhesion between the pattern mask and the substrate during the printing process (e.g., the LEP printing process). For example, the adhesion enhancer establishes adhesion and maintains adhesion integrity between the pattern mask and the substrate during the roll-to-roll mask printing process even though the organosilane coating is a very thin layer. As such, the enhanced adhesion of the pattern mask to the substrate surface facilitates withstanding any mechanical stresses imparted by winding and rewinding the substrate during the roll-to-roll printing process.

Moreover, the adhesion enhancer coating on the substrate facilitates adhesion between the pattern mask and the substrate during substrate patterning even though the organosilane coating is a very thin layer. For example, the enhanced adhesion of the pattern mask facilitates withstanding one or both of chemical and mechanical stresses imparted by patterning the substrate during circuit fabrication (e.g., using one or both of wet etching and dry etching of thin film material layers on the substrate surface).

In addition, the organosilane coating does not interfere with the substrate patterning process when applied in the very thin layer. In contrast, a relatively thick layer of an organosilane (e.g., greater than approx. 0.2 microns thick) on the substrate surface may passivate the surface and not allow wet etching of the material layers on the surface, for example. In addition, the organosilane coating does not interfere with removal of the pattern mask after substrate patterning. For example, the organosilane coating does not affect one or both of the materials for and the process of removing the pattern mask.

In some embodiments of the present invention, the polymer-based pattern mask comprises a polymer-based liquid toner. The pattern mask is produced by imparting a pattern (i.e., masking pattern) to the liquid toner to produce a 'patterned liquid toner' using the LEP process. The patterned liquid toner is deposited onto the substrate using the LEP process. In some embodiments, the patterned liquid toner is partially or completely dried and fused prior to being deposited onto the substrate surface (e.g., offset printing) to produce the pattern mask.

Herein, the terms 'polymer-based pattern mask' and 'pattern mask' may be used interchangeably with 'liquid toner pattern mask' for simplicity of discussion only and not by way of limitation. The pattern mask may comprise another polymer-based material compatible with such roll-to-roll processing other than a liquid toner and still be within the scope of the various embodiments herein.

According to various embodiments herein, the pattern mask facilitates high speed processing of substrates using digital mask definition and deposition. For example, the liquid toner pattern mask may be employed in roll-to-roll, high-throughput patterning of large-area flexible substrates used for flexible displays and related flexible circuits. Using digital mask definition, a configuration of the pattern mask may be changed 'on the fly' during masking in the roll-to-roll LEP printing process. In another example, the pattern mask may be employed to mask successive, discrete substrates for subsequent patterning. In this example, a configuration of the pattern mask may be changed 'on the fly' (e.g., from one substrate to the next or within a substrate). Various embodiments of the present invention facilitate both single-sided and double sided patterning and are applicable to single layer as well as multi-layer printed circuit fabrication.

The polymer-based pattern mask according to various embodiments of the present invention is applicable to a wide variety of substrate patterning methodologies including, but not limited to, pattern etching and pattern lift-off. The term 'etching' as used herein generally includes both dry etching and wet etching. An 'etchant', as referred to herein, is an active agent employed in an etching process. For example, a solution of either a strong acid or a strong base may be the etchant in an exemplary wet etching process. An oxygen, fluorinated or chlorinated plasma may serve as the etchant in an exemplary dry etching process, such as reactive ion etching (RIE)), for example.

In pattern etching, the pattern mask acts to cover and protect a portion of the substrate while allowing the etchant to etch other exposed or uncovered portions thereof. In pattern lift-off, the pattern mask is applied to the substrate and then a layer or layers to be patterned is applied over the pattern mask. Removal of the pattern mask 'lifts-off' those portions of the layer to be patterned (e.g., metallization) that are not in contact with the substrate.

In some embodiments, the substrate material is selected from a flexible material including, but is not limited to, polyimide and polyester. A thin layer of material to be patterned into a device layer is formed on one or both major surfaces (i.e., front and back) of the substrate. In some embodiments, subsequent layers of materials are formed and patterned on the surface(s), such as in fabricating a multilayer circuit. For the purposes of the various embodiments herein, the material layer to be patterned comprises a material that is compatible with the organosilane adhesion enhancer. This is so whether it is the substrate material itself or another material on the substrate surface that is to be patterned. By definition, and as used herein, a material that is 'compatible with the organosilane', or the term 'compatible material' or 'compatible surface' comprises a material that has or forms a stable surface oxide with sufficient hydroxyl functionality to interact with the functional groups of the organosilane adhesion enhancer. By 'stable surface oxide' it is meant that the surface oxide has mechanical strength, chemical stability and does not dissolve in solution, (e.g., is hydrolytically stable). By 'sufficient hydroxyl functionality' it is meant that the presence of hydroxyl (—OH) surface groups is essential for coupling with silanol (Si—OH) groups (or siloxy (Si—OR) groups) of the respective organosilane, as further described below, by way of hydrogen bonding to ultimately form a chemical bond.

Materials to be patterned that are compatible to the organosilane adhesion enhancer include, but are not limited to, those metals, semiconductors, oxides (both conductive and semiconductive), and dielectrics that form stable surface oxides in either aqueous solution or nonaqueous solution. For example, compatible semiconductor materials comprise one or more of silicon (Si), germanium (Ge), gallium arsenide (GaAs), indium tin oxide (abbreviated 'ITO'), and zinc oxide (ZnO). Compatible dielectric materials comprise silicon dioxide ($SiO_2$), germanium dioxide ($GeO_2$), fluorosilicates, and zirconium silicate, for example.

Compatible metals include, but are not limited to, aluminum, chromium, tin, tantalum and titanium, and various alloys and oxides thereof. However, certain other metals including, but not limited to, iron, copper and zinc form surface oxides that are less stable than the above-listed compatible metals, such that surface oxides of these other metals tend to one or both of dissolve in solution and lack mechanical strength (e.g., hydrolytically unstable). As such, these other metals provide surface oxides with insufficient hydroxyl functionality to interact with the organosilane adhesion enhancer. In some embodiments, enhancing adhesion to these other metals includes using a secondary silane with a reactivity or functionality compatible with these metals either in addition to or in lieu of the organosilane adhesion enhancer and therefore, are still within the scope of the various embodiments herein. In contrast, precious metals, such as gold, and other metals, such as nickel, for example, do not readily one or both of form oxides and react with silanes to promote adhesion and therefore, are incompatible with the organosilane adhesion enhancer according to the various embodiments herein.

For simplicity of discussion only, no distinction is made herein between the substrate itself and the substrate comprising one or more material layers to be patterned on a surface of the substrate (e.g., a surface metallization layer, cladding or foil) unless such distinction is necessary for proper understanding. Thus, by definition herein 'patterning the substrate' refers equally to patterning the substrate itself or to patterning a material layer or layers on the substrate surface, excluding the adhesion enhancer layer or coating. Also, by definition 'substrate surface' refers equally to a surface of the substrate itself or a material layer on the substrate surface. In particular, 'patterning the substrate' explicitly includes patterning one or more thin film material layers (e.g., multiple thin film layers) on or adjacent to one or both of a front surface and a back surface of the substrate, according to some embodiments. For example, 'patterning the substrate' may comprise selectively removing, by pattern etching, portions of a thin film material layer on the substrate surface where the thin film material layer comprises one or more of a semiconductor, a dielectric and a conductor, each of which is organosilane-compatible, as defined above.

As used herein, the article 'a' is intended to have its ordinary meaning in the patent arts, namely 'one or more'. For example, 'a layer' means one or more layers and as such, 'the layer' means 'the layer(s)' herein. Moreover, any reference herein to 'top', 'bottom', 'upper', 'lower', 'left' or 'right' is not intended to be a limitation herein. Further, examples herein are intended to be illustrative only and are presented for discussion purposes and not by way of limitation.

FIG. 1 illustrates a flow chart of a method 100 of masking a substrate according to an embodiment of the present invention. The method 100 of masking a substrate produces a pattern mask having enhanced adhesion that may be employed to pattern the substrate, according to some embodiments. The pattern mask produced by the method 100 of masking is generally applicable to substrate patterning processes, such as pattern etching and pattern lift-off.

The method 100 of masking a substrate comprises applying 110 a coating of an organosilane to a surface of a substrate to be patterned; and printing 120 a pattern mask on the organosilane-coated substrate surface. The substrate surface is compatible with the organosilane, as defined above. For example, the substrate surface comprises a stable oxide with sufficient hydroxyl functionality. In some embodiments, the organosilane coating is applied 110 using a deposition technique that is compatible with roll-to-roll processing. The deposition technique includes, but is not limited to, one or more of an immersion technique, an inkjet technique, a spray technique, gravure coating and vapor phase deposition to achieve a very thin film or layer of the organosilane coating. In some embodiments, the organosilane coating is applied 110 from an aqueous media. In other embodiments, the organosilane coating is applied 110 from a non-aqueous media.

Low molecular weight organosilanes provide one or both of solubility in aqueous media and application in a very thin layer to a surface with a targeted surface coverage. In some embodiments, the molecular weight of the organosilane is less than about 700 to achieve one or both of such aqueous solubility and very thin application. According to the various embodiments herein, the organosilane is applied 110 in a very thin layer that is also referred to herein as a 'molecular layer'. By definition, the very thin layer, the thickness of which is measured in angstroms instead of microns, comprises one or more molecular layers. In some embodiments, the organosilane is applied 110 in a range of 1 to 8 molecular layers. A range of 1 to 8 molecular layers has a thickness in a range of about 10 angstroms to about 100 angstroms, for example, and depends on the organosilane chosen and its surface coverage. By way of example, a number of organosilanes from Gelest, Inc., which are further identified below, may be arranged based on the thickness of a molecular layer thereof as follows: SIA0590.0≧WSA7021>WSA9911≧WSA7011.

The 'organosilane' adhesion enhancer is also referred to herein interchangeably as an 'amino-organosilane' that enhances adhesion between the substrate surface and the polymer-based pattern mask, such as the liquid toner pattern mask. In some embodiments, the amino-organosilane is a water-borne amino-organosilane. In other embodiments, the amino-organosilane is a non-hydrolyzed version of the amino-organosilane. Water-borne amino-organosilanes comprise a hydrolyzable functional group including, but not limited to, alkoxy, acyloxy, halogen and amine, which hydrolyzes and forms a reactive silanol group (Si—OH). In some embodiments, the amino-organosilane comprises three silanol groups, wherein one or two of the silanol groups are available to condense and form a polymer, and wherein a silanol group is available to interact with the hydroxyl functionality of the compatible substrate surface. The non-hydrolyzed version of the amino-organosilane comprises three siloxy groups (Si—OR) where R is either a hydrogen or an alkyl group, for example. In some embodiments, R is an alkyl group that has from 1 to 3 carbon atoms that facilitates hydrolysis and condensation to one or both form a polymer and to interact with the compatible substrate surface.

The amino-organosilane further comprises a non-hydrolyzable amine functional group that interacts with the pattern mask. The amine functional group includes within its scope herein any of 'monoamine', 'diamine' and 'triamine' functionalities and their corresponding 'monoaminoalkyl', 'diaminoalkyl' and 'triaminoalky' functionalities. As used herein, 'alkyl' includes within its scope, but is not limited to, methyl, ethyl, propyl, isopropyl, butyl and isobutyl. For simplicity of discussion herein and not by way of limitation, the terms 'organosilane' and 'amino-organosilane' are defined herein to include any of the amine functionalities provided above unless a distinction is provided. The combination of interactions of the various functional groups of the amino-organosilane with the substrate surface and the pattern mask promotes adhesion of the pattern mask to the substrate.

Depending on the embodiment, the organosilane coating comprises one of a monomer, a copolymer and an oligomer. In some embodiments, the amino-organosilane is an aminoalkyl-silanetriol monomer. In some embodiments, one or both of the organosilane copolymer and the organosilane oligomer comprises an aminoalkyl-silsesquioxane. The water-borne aminoalkyl-organosilanes are compatible with deposition from an aqueous media. The non-hydrolyzed aminoalkyl-organosilanes are compatible with deposition from a non-aqueous media.

The amino-organosilanes used for the various embodiments herein are commercially available and may be obtained from Gelest, Inc., Morrisville, Pa. In some embodiments, the water-borne aminoalkyl-organosilane is selected from one of N-(2-aminoethyl)-3-aminopropyl-silanetriol monomer (Gelest Catalog No. SIA0590.0), an aminopropyl-silsesquioxane oligomer (Gelest Catalog No. WSA-9911), a copolymer of 65-75% aminoethyl-aminopropyl-silsesquioxane and 25-35% methyl-silsesquioxane (Gelest Catalog No. WSA-7021), and a copolymer of 65-75% aminopropyl-silsesquioxane and 25-35% methyl-silsesquioxane (Gelest Catalog No. WSA-7011). In some embodiments, the non-hydrolyzed aminoalkyl-organosilane includes, but is not limited to, N-(2-aminoethyl)-3-aminopropyl-trimethoxysilane (Gelest Catalog No. SIA0591.0) and N-(2-aminoethyl)-3-aminopropyl-triethoxysilane (Gelest Catalog No. SIA0590.5).

The silanol groups of the respective water-borne amino-organosilane (i.e., hydrolyzed functional groups) have high reactivity and at least one of the silanol group forms a chemical bond with the compatible substrate surface. Likewise, at least one of the siloxy groups of the non-hydrolyzed version of the amino-organosilane forms a chemical bond with the compatible substrate surface. Moreover, the amine group (i.e., non-hydrolyzable functional group) of both the water-borne and the non-hydrolyzed amino-organosilanes offers a number of advantages in the embodiments of the present invention. For example, for the water-borne amino-organosilanes, there is internal hydrogen bonding between the amine group and the silanol group that stabilizes an aqueous solution of the organosilane. Moreover, the amine group of both of the water-borne and the non-hydrolyzed amino-organosilanes provides one or both of hydrogen bonding and acid-base interactions with a functional group from the polymer resin of the polymer-based pattern mask to enhance adhesion of the pattern mask to the substrate. The functional group of the polymer-based pattern mask includes, but is not limited to, carboxylic acid, ether, alcohol and amide, and depends on the polymer resin of the polymer-based pattern mask.

The compatible substrate material, having sufficient hydroxyl functionality, as described above, will chemically bond (e.g., covalent bonding) with the organosilane via the silanol group or the siloxy group, depending on the organosilane used. For example, an aluminum film on a surface of a flexible polyimide substrate has inherent passivation that provides sufficient hydroxyl functionality to chemically bond with the silanol groups of the respective organosilane. Moreover, the compatible substrate material may be pre-treated to provide hydroxyl functionality sufficient for bond formation with the silanol group or siloxy group of the respective organosilane (e.g., oxygen plasma treatment).

In some embodiments, applying 110 a coating comprises dispersing the organosilane in an aqueous solution; depositing the solution on the substrate; and drying the organosilane coating on the substrate such that a covalent linkage is formed between the coating and the substrate with a concomitant loss of water. In some embodiments, applying 110 a coating comprises dispersing a non-hydrolyzed organosilane in a non-aqueous media; depositing the non-hydrolyzed organosilane on the substrate; and treating the non-hydrolyzed organosilane to enhance hydrolysis and condensation with the substrate.

In some embodiments, dispersing the water-borne organosilane in an aqueous solution comprises mixing a quantity of the amino-organosilane in water, for example from about 0.01 weight percent (wt %) to about 1.0 wt %, and adjusting the pH, as described below, for example, to encourage one or both of hydrolysis and condensation, if applicable. In some embodiments, depositing the solution comprises immersing the substrates into the aqueous organosilane solution for a period of time, for example about 1 minute to about 5 minutes at a specific pH, for example ranging from about pH 7 to about pH 12, or as described below, and a specific temperature, for example a temperature between room temperature or about 20° C. to about 60° C. In some embodiments, drying the organosilane coating on the substrate comprises one or both of baking the solution-coated substrate at a temperature within a range of about 90° C. to about 120° C., for example, and evacuating water from the coating solution, both for a period of time, for example from about 5 minutes to about 1 hours.

In some embodiments, applying 110 a coating further comprises adjusting a pH of the aqueous solution to a pH less than or equal to pH 9 before depositing. The pH may be adjusted using acetic acid, in some embodiments. The natural pH of a variety of water-borne amino-organosilane solutions, for example those selected from the list above, is greater than pH 9. The condensation reaction of the silanol group to one or both of crosslink into polymeric form and interact with an oxidized surface (such as a passivated aluminum surface) occurs between about pH 8 and about pH 12, for example. Drying the amino-organosilane solution on the substrate facilitates one or both of covalent bonding with the substrate surface and crosslinking the organosilane.

In some embodiments, adjusting a pH accommodates the substrate material on which the organosilane coating is applied 110. For example, an aluminum film on the substrate may corrode when the pH is less than about pH 4 or greater than about pH 8. Therefore, when applying 110 the organosilane coating on an aluminum substrate surface, according to some embodiments, consideration is given to the pH of the amino-organosilane solution as well as one or both of temperature and time. As such, applying 110 a coating of an organosilane to an aluminum surface of a substrate may comprise adjusting the pH of the aqueous solution to be less than or equal to pH 8 and more than or equal to pH 4, for example.

In an example of patterning an aluminum layer on a substrate, the pH of the organosilane in aqueous solution is adjusted to between pH 7 and pH 8 to apply 110 the organosilane layer on the aluminum surface and one or both to avoid damage to the aluminum and obtain good coverage. For the purposes of some embodiments herein, wherein aluminum is to be patterned, using a organosilanol form of the corresponding organosilane precursor, such that it already includes silanol groups, will avoid exposing the aluminum to a hydrolysis reaction at a pH less than about pH 5.

The pH stability of organosilane aqueous dispersions (i.e., solutions) was evaluated for various coating processes. For example, when using a dip bath (i.e., immersion) roll-to-roll process of a web substrate (of a web-fed press, for example), the pH of the organosilane is expected to remain stable for the time required to coat the entire web. In pH stability tests at room temperature, the pH of solutions comprising 0.1% reactive aminoethyl-aminopropyl-organosilanes (e.g., either SIA0590.0 or WSA-7021 from Gelest, Inc.), that were adjusted to pH 7 with acetic acid, were measured periodically for more than 100 hours. The pH of the solutions remained stable for at least the 100 hours. As such, no buffer was required to maintain the aqueous solutions at a neutral pH. Moreover, the organosilane aqueous solutions remained clear during the 100 hours. The solution clarity over time may be attributable to internal hydrogen bonding between the silanol group and the amine group, for example, to prevent condensation of the silanols to siloxanes, which may eventually precipitate and cloud the solution.

Referring again to FIG. 1, printing 120 a pattern mask on the organosilane-coated substrate, according to the method 100 of masking, comprises using a roll-to-roll printing system to print a polymer-based pattern mask in a predetermined mask pattern. For example, a liquid electrophotographic (LEP) printer is a roll-to-roll printing system useful for printing 120 a pattern mask. In some embodiments, LEP printing is a thermal offset printing process. The organosilane coating applied 110 to the substrate surface enhances adhesion between the printed 120 pattern mask and the substrate during printing 120. For example, enhanced adhesion is achieved through increasing an acid-base interaction between the substrate and the pattern mask using the functional groups of the organosilane coating to enhance hydrogen bonding. For example, the organosilane coating facilitates a more robust bond between the pattern mask and the substrate surface than that provided between the pattern mask and the substrate without such an adhesion enhancer.

In some embodiments, a liquid toner is printed 120 as the pattern mask using LEP printing. The liquid toner is polymer-based, as further described herein. In some liquid toner embodiments, printing 120 a pattern mask comprises imparting a pattern (i.e., masking pattern) to the liquid toner to yield 'a patterned toner'. Herein, 'imparting the pattern' is also referred to as 'patterning the liquid toner' (i.e., the 'patterned toner'). Printing 120 a pattern mask further comprises fusing the patterned toner to produce the pattern mask. Printing 120 a pattern mask further comprises applying the patterned toner to a surface of the substrate.

In some embodiments, the patterned toner is completely fused prior to being applied to a surface of the substrate. In such embodiments, applying the patterned toner essentially applies the pattern mask to the substrate surface. In other embodiments, fusing the patterned toner is performed after applying the patterned toner to the substrate surface. In such embodiments, the pattern mask is produced in situ on the substrate surface from the applied but not yet fused patterned toner. In yet other embodiments, the patterned toner is partially fused prior to being applied and then, is further fused once applied to yield the liquid toner pattern mask that masks the substrate. However, in all embodiments, the liquid toner is always patterned prior to being applied to the substrate surface. The patterned toner bonds with the substrate surface upon application as the pattern mask, which is facilitated by the organosilane adhesion enhancer (i.e., via increased hydrogen bonding).

The liquid toner comprises a carrier liquid and polymer-based toner particles dispersed in the carrier liquid. The polymer-based toner particles are electrically charged or at least capable of being electrically charged, depending on the embodiment. Typically, toner particles in the liquid toner are charged using charge directors as opposed to triboelectrification which is used with dry toners. As such, the liquid toners are readily distinguished from their dry toner counterparts. The electrical charge of the toner particles is employed to electrically control a deposition location of the particles during toner patterning. In some embodiments, the location of the particles is a result of electrically guiding the particles during toner patterning using an electric field. Additional information regarding using liquid toners as a pattern mask, printing thereof and further processing of a substrate, for example, can be found in co-pending U.S. patent application Ser. No. 11/733,176, filed Apr. 9, 2007, which is incorporated by reference herein in its entirety.

According to the various embodiments herein, a polymer-based pattern mask comprises a functional group that facilitates bonding to substrate surfaces using the amino-organosilane. For example, the liquid toner pattern mask comprises carboxyl functional groups that interact with the amino groups of the organosilane through acid-base interactions to form hydrogen bonds. The polymer-based toner particles of the liquid toner comprise a polymer that is resistant to an etchant once fused on the substrate during printing 120 a pattern mask. Moreover, the organosilane adhesion enhancer enhances a bond between the fused polymer and the substrate such that the bond is resistant to such an etchant. The polymer of the toner particles may comprise a blend of polymers (i.e., a polymer blend) in some embodiments. Examples of liquid toners and constituent toner particles thereof are described in a number of U.S. patents including, but not limited to, U.S. Pat. Nos. 4,794,651, 4,842,974, and 6,146,803, all of which are incorporated by reference herein. In some embodiments, the polymer blend comprises one or both of a polymer and a copolymer. For example, the polymer blend may comprise a first polymer and a second polymer as described by Ben-Avraham et al., U.S. Pat. No. 7,078,141 B2, incorporated herein by reference. In some embodiments, the liquid toner comprises a commercially available polymer-based liquid toner such as, but not limited to, Electrolnk®. Electrolnk® is a registered trade mark of Indigo, N.V., The Netherlands, and is owned and marketed by Hewlett-Packard Development Company, Texas (hereinafter 'Hewlett-Packard') as 'HP Electrolnk'.

HP Electrolnk comprises a polymer blend of ethylene acrylic acid and methacrylic acid copolymers. The polymer blend of HP Electrolnk lacks ester groups that might suffer from hydrolytic degradation that may be accelerated by strong acids and strong bases often employed as wet etchants for circuit board and semiconductor processing. As such, the HP Electrolnk polymer blend is compatible with a majority of wet etchants in current use for circuit fabrication. The HP Electrolnk polymer blend is equally compatible with various plasma chemistries employed in dry etching (e.g., etching aluminum with $BCl_3/Cl_2$ plasmas).

Herein, reference to a 'liquid toner' explicitly includes any liquid toner marketed as HP Electrolnk or equivalent thereto, unless otherwise stated. In addition to ethylene acrylic acid and methacrylic acid copolymers of HP Electrolnk mentioned above, the polymer blend may comprise various polymer and copolymer resins including, but are not limited to, ethylene acrylic acid copolymer, acid-modified ethylene acrylate copolymer, copolymer of ethylene-glycidyl methacrylate, terpolymer of ethylene-methyl acrylate-glycidyl methacrylate, and similar, related resin compounds.

HP Electrolnk and other equivalent liquid toners generally employ toner particles having a size range of about 3 microns or smaller. By comparison, dry toners typically employ much bigger toner particles (e.g., typically 5-10 microns) since smaller particles used as a dry toner cannot be readily controlled and effectively guided during printing. Liquid toner overcomes the control problem of small particles by the addition of the liquid carrier, among other mechanisms. As such, using the liquid toner as a pattern mask may result in a relatively thinner, more uniform, pattern mask that exhibits significantly improved resolution and line edge fidelity than would be possible with a dry toner-based mask. In addition, the use of liquid toner may greatly reduce a presence of unwanted background printing in non-image areas of the pattern mask.

Furthermore, HP Electrolnk fuses at about 90 degrees Celsius (° C.). Dry toners typically require 140° C.-160° C. for fusing, which can severely limit a selection of substrate materials that may be employed. Using liquid toner, such as HP Electrolnk, facilitates a wider choice of substrate materials especially when considering flexible and/or organic material-based substrates. Similarly, the polymer-based liquid toners typically produce a more flexible printed image than is possible with dry toners such that the use of liquid toners for pattern mask applications involving flexible substrates is further facilitated.

Liquid electrophotographic (LEP) printing, which is used in printing 120 a pattern mask according to the method 100 of masking, is a form of digital electrophotographic printing that is a roll-to-roll printing process, as described above.

Herein, digital electrophotographic printing is also known as electro-digital printing (EDP). In some embodiments, an offset LEP printing or more specifically, thermal offset LEP printing, may be employed during printing 120 a pattern mask, according to some embodiments.

In thermal offset LEP printing, a pattern (e.g., mask pattern) is created and optically written onto an electrophotographic photosensitive imaging plate (PIP). For example, the PIP may be scanned by an array of lasers under control of a digitally defined pattern. The liquid toner is then sprayed, rolled or otherwise applied onto the PIP in an inking operation. A desired pixel pattern on the PIP is produced by a developer roller. Charged toner particles of the liquid toner preferentially adhere to image areas of the PIP and are removed from non-image areas such that the remaining liquid toner takes on the desired pixel pattern of the PIP.

The patterned liquid toner is transferred to an electrically charged blanket of an offset or transfer cylinder. The patterned toner is heated on the transfer cylinder to remove the carrier liquid and to partially melt and fuse the toner particles. The melting and fusing causes the toner particles to coalesce into a relatively smooth, continuous patterned film. The fused toner particles essentially form a hot adhesive plastic on the transfer cylinder blanket while retaining the pattern. Finally, the fused toner particles on the blanket of the transfer cylinder are brought into contact with and transferred to the substrate. The substrate is held at a temperature that is cooler than the transfer cylinder blanket to facilitate the transfer of the fused patterned toner to the substrate as the pattern mask. Examples of offset LEP printers that may be used to print 120 the pattern mask onto the organosilane-coated substrate according to the present invention include either web-fed presses or sheet-fed presses such as, but are not limited to, the HP Indigo web-fed press ws4050, the HP Indigo press ws4500, and the HP Indigo sheet-fed press 5000 series printers, all products of Hewlett-Packard.

In some embodiments, multiple layers of the liquid toner may be used to produce the liquid toner pattern mask. In particular, the use of multiple layers may improve characteristics of the liquid toner pattern mask related to one or more of mask porosity, edge quality and percent coverage when compared to a pattern mask using a single layer of liquid toner. In general, multiple layers of liquid toner may be applied during printing 120 a pattern mask using successive passes of the substrate through the LEP printer. In each pass, an additional layer of liquid toner is added to the pattern mask on the substrate.

Alternatively, multiple layers of liquid toner may be printed 120 in a single pass on the substrate through the LEP printer. For example, when using offset thermal LEP printing, multiple layers of liquid toner may be patterned and accumulated on the transfer cylinder blanket prior to being applied to the substrate surface in a single transfer pass during printing 120. Registration between multiple layers of liquid toner on the transfer cylinder is generally much easier to control than applying the patterned toner to the substrate in successive passes. As such, excellent pattern fidelity may be achieved using the single pass multilayer approach.

In addition, most offset thermal LEP printers are color printers that have an ability to deposit each of several colors of toner onto a substrate. Such LEP printers often deposit multiple colors onto the transfer cylinder prior to transferring the color image to the substrate as a normal part of printing a color image. As such, advantage may be taken of this inherent ability to print multiple colors by 'stacking' liquid toners that represent different colors to produce the desired multiple layers of liquid toner. In stacking, liquid toner representing each of several colors is printed in a common region of the image, one on top of the other. For example, creating a two-layer pattern mask may be realized by printing liquid toner representing two different colors in a same region of the mask pattern. An actual pigment color of the liquid toner is not generally a concern in printing 120 a pattern mask. For example, a black toner and a cyan toner may function equally well as the liquid toner pattern mask.

In some embodiments, the method 100 of masking further comprises removing the pattern mask from the substrate surface. In some embodiments, the pattern mask is removed from the substrate surface using a lift-off agent having a basic pH. The pattern mask is typically lifted-off after a pattern is created in surface layer of the substrate. For example, the substrate may comprise a compatible metal film on the surface of the substrate, and the organosilane coating is applied 110 to the metal film. In this example, the pattern mask is printed 120 on the organosilane-coated metal film and the metal film is patterned according to a predefined pattern of the pattern mask. Patterning the substrate surface is described further below with respect to a method 200 of patterning a substrate. After the metal film is patterned, such as by etching, the pattern mask is removed using the lift-off agent at a basic pH.

The basic pH of the lift-off agent is a pH generally much greater than about pH 7.0. In some embodiment, the basic pH is between about pH 11 and about pH 14. Removing the pattern mask using a lift-off agent (i.e., lift-off of the pattern mask) is not to be confused with 'pattern lift-off' for patterning the substrate. However, removing the pattern mask may be employed to realize 'pattern lift-off' during patterning, in some embodiments, as is further described below.

Exposure of the pattern mask to the lift-off agent during removal acts to break a bond between the surface of the substrate and the pattern mask to disconnect the pattern mask from the substrate. The organosilane coating adhesion enhancer neither interferes with nor hinders removal of the pattern mask using the lift-off agent. In some embodiments, the lift-off agent is a lift-off solution comprising a relatively strong base. A lift-off agent or solution is distinguished from a solvent that dissolves a material of the pattern mask. Specifically, the lift-off agent primarily affects the bond between the substrate surface and the pattern mask and not an overall integrity of the pattern mask itself. For example, the lift-off agent affects the bond (i.e., hydrogen bonding) between the amine functional group of the organosilane coating and the respective functional group of the pattern mask. In some embodiments, the pattern mask may be removed from the substrate surface in an essentially intact configuration using the lift-off agent. In other words, the lift-off agent may essentially 'lift-off' an intact pattern mask from the substrate. In other embodiments, the lift-off agent may both lift-off and partially or completely dissolve (or otherwise disintegrate) the pattern mask during removing the pattern mask.

In effect, the organosilane coating stays on the substrate surface after the lift-off process of the pattern mask. Subsequent removal of the organosilane coating from the substrate surface is optional. The organosilane coating has two components, for example, an organic component and a silicate component. The organic component of the organosilane coating may be subsequently removed with oxygen RIE, for example. The silicate component of the organosilane coating may remain on the surface after the organic component is removed. Alternatively, the silicate component may be removed with a silicate etchant. For the aluminum surface layer example, a remaining aluminosilicate component may be removed using commercially available etchants, such as Transene Type F etchant available through Transene Company, Inc. Danvers, Mass. (e.g., http://www.transene.com/aluminum.html).

In some embodiments, the lift-off agent comprises tetramethyl ammonium hydroxide (TMAH) as the strong base. In some such embodiments, an aqueous solution of TMAH is employed. For example, an aqueous solution of TMAH having a pH that is greater than or equal to about 13 may be employed as the lift-off agent. TMAH has an absence of metal ions that may adversely affect or contaminate the substrate being patterned and is generally compatible with conventional circuit processing and fabrication. For example, metal ions can diffuse into device layers and adversely affect electrical characteristics thereof.

In an example of lifting off a liquid toner pattern mask, HP Electrolnk was deposited on an amino-organosilane coated aluminum clad polyimide substrate and later removed by exposing the substrate to an aqueous solution of TMAH at room temperature. Removal of two deposited layers of HP Electrolnk was demonstrated to occur in less than about 40 seconds with a 2.5% TMAH solution at room temperature and having a pH of about 13. The inclusion of the organosilane adhesion enhancer did not hinder the removal or change the removal parameters or the results.

Other lift-off agents include, but are not limited to, aqueous solutions comprising one or more of potassium hydroxide (KOH), sodium hydroxide (NaOH) benzyltrimethyl ammonium hydroxide, tetraethyl ammonium hydroxide, tetrabutyl ammonium hydroxide and tetrapropyl ammonium hydroxide. Similarly, combinations of any of the above listed aqueous solutions and TMAH may also be employed as the lift-off agent. Further, non-aqueous solutions of TMAH and similar compounds may also be employed as the lift-off agent, according to embodiments of the present invention.

In some embodiments, the lift-off agent further comprises a passivating agent. The passivating agent mitigates any deleterious effect that the basic pH may have on the substrate during removing the pattern mask. For example, the passivating agent may be used to protect an organosilane-coated metal layer on the substrate from being etched by the lift-off agent during removal of the pattern mask. Since the organosilane layer is applied 110 in a very thin layer, there may be less than 100% coverage of the metal surface or the very thin layer may be porous. As such, the organosilane coating alone may not adequately protect metals, such as aluminum, from being etched during pattern mask removal. The passivating agent protects the underlying metal during removal of the pattern mask with the lift-off agent at the basic pH.

In some embodiments, silicic acid is employed as the passivating agent. For example, an aqueous solution comprising TMAH and silicic acid may be employed as the lift-off agent. However, the presence of silicic acid may increase a lift-off time of removing the pattern mask, regardless of whether the organosilane coating is present. An aqueous solution of about 5% TMAH and 28 grams/Liter (g/L) of silicic acid provided a reasonable trade-off between aluminum passivation and lift-off time when HP Electrolnk was employed as the liquid toner. The organosilane coating did not change these results and therefore, the organosilane coating did not interfere with the pattern mask removal process.

In some embodiments, the lift-off solution is made by adding deionized water to a 25% TMAH semiconductor grade solution to obtain a desired TMAH concentration (e.g., 5% TMAH solution). Silicic acid is then added to a desired concentration (e.g., 28 g/L) and the solution is heated to dissolve the silicic acid. For example, the solution may be heated to about 80° C. for about 30 to 60 minutes to completely dissolve the silicic acid. Water evaporation during dissolution may be minimized by using a beaker with a reflux condenser, for example. In some embodiments, full dissolution of silicic acid is targeted and the solution is discarded if any undissolved silicic acid is detectable after about 60 minutes.

As was noted above, in some embodiments, non-aqueous TMAH solutions may be employed as the lift-off agent for removing the pattern mask. For example, a non-aqueous TMAH solution known as RPX-127 may be used as the lift-off agent. RPX-127 comprises 30% dipropylene glycol monomethyl ether, 75% dimethyl sulfoxide and 4% TMAH pentahydrate and is marketed by Rohm and Hass, Philadelphia, Pa. Removal of two layers of printed HP Electrolnk with the RPX-127 lift-off agent used a somewhat longer exposure time and a higher temperature than room temperature when compared to the aforementioned aqueous solution of TMAH. In some embodiments, the lift-off agent may comprise or further comprise a mechanical means for breaking the bond between the pattern mask and the substrate. The organosilane coating had no impact on the pattern mask removal process using a non-aqueous lift-off agent.

In some embodiments of the method 100 of masking a substrate, a coating that acts as an adhesion layer between the substrate and a metal layer to be patterned on the substrate surface is useful. For example, TMAH is known to attack and degrade polyimide under certain circumstances. Employing an adhesion layer such as, but not limited to, silicon dioxide ($SiO_2$) or silicon nitride ($Si_3N_4$), between the polyimide substrate and an aluminum layer, for example, helps to prevent the TMAH lift-off agent from degrading the polyimide and from adversely affecting the adhesion of the aluminum layer to the polyimide substrate. In particular, both $SiO_2$ and $Si_3N_4$ independently exhibit excellent selectivity to TMAH.

In some embodiments, the method 100 of masking a substrate further comprises removing the organosilane coating from the substrate surface. For example, the coating may be removed after patterning a metal film layer on the substrate, as mentioned above. Any of the amino-organosilanes mentioned above can be readily removed from the substrate surface using an oxygen reactive ion etching (RIE) plasma, for example.

Using the organosilane coating on the substrate surface supersedes annealing the liquid toner pattern mask following printing 120 to enhance adhesion. Annealing was used to volatilize any residual carrier liquid or solvent in the printed pattern mask to improve adhesion of the pattern mask to the substrate. However, annealing included heating the substrate with the printed pattern mask to a temperature that may be incompatible with the substrate.

For example, HP Electrolnk comprises an isoparaffin solvent (Isopar®) as a carrier liquid. Isopar® is a registered trademark of ExxonMobile, NJ. Isopar® has a boiling point of 189° C. but begins to evaporate around 100° C. and exhibits a relatively higher evaporation rate in a temperature range between 120° C. and 130° C. The main resin of HP Electrolnk is a polyethylene with a linear coefficient of thermal expansion (CTE) of about 150 ppm/K. If one or both of the substrate material is a polyimide (CTE between 12-20 ppm/K) and the substrate surface comprised a metal film, such as aluminum (CTE 20 ppm/K), then the CTE of the HP Electrolnk is about 10 times higher than the surface on which it is printed. As such, annealing this combination of materials to a temperature of between about 100° C. and about 130° C. may cause the liquid toner pattern mask to buckle during roll-to-roll processing and affects an efficiency of the pattern mask as an etch mask.

Using a plasma pre-treatment of the surface of the substrate prior to printing the pattern mask improved adhesion, but in some embodiments, the adhesion was improved only when the pattern mask was printed directly after the plasma pre-treatment. Otherwise, the pre-treated surface continued to collect contaminants that ultimately depleted the adhesion of the printed pattern mask. According to the various embodiments herein, the organosilane coating applied 110 to the substrate surface supersedes printing immediately after such surface pre-treatment.

A polyethyleneimine (Lupasol®) coating can be used to enhance adhesion of HP Electrolnk to a paper substrate, for example. Lupasol® is a registered trademark of BASF Corporation, NJ. While polyethyleneimine may be useful on paper substrates, it does not chemiadsorb well to metal surfaces and therefore, has limited use in printed circuit fabrication. Moreover, polyethyleneimine has a relatively high molecular weight of about 700,000. This 'high' molecular weight material creates a relatively thick coating that can inhibit, mask or delay wet etching during patterning the substrate. The organosilanes listed above will chemiadsorb to various compatible substrate materials including, but not limited to, oxidized metals, when applied 110; and the organosilanes have relatively low molecular weights, ranging from about 180 to about 650, for example. As mentioned above, the relatively low molecular weight of the organosilanes allows the organosilanes to be applied as relatively very thin coatings on the substrate surface, for example, in one or more molecular layers. Such very thin coatings work well to enhance adhesion of the pattern mask to the substrate surface during subsequent processing of the substrate (e.g., patterning), but do not impact any of patterning of the substrate surface, removal of the pattern mask, and removal of the organosilane coating from the surface during subsequent processing of the substrate.

In some embodiments, the method 100 of masking a substrate further comprises cleaning the substrate surface prior to applying 110 a coating of an organosilane. For example, the substrate surface may be exposed to a plasma treatment (e.g., reactive ion etching) using one or both of oxygen and argon to thoroughly clean the surface prior to applying 110 the organosilane coating. The organosilane adhesion enhancer is a material that is introduced to facilitate a bond between the substrate surface and the pattern mask. The adhesion enhancer may further one or both of reduce an effect that an etchant has on the bond and facilitate an action of the lift-off agent, according to various embodiments.

Adhesion of a polymer-based pattern mask on water-borne amino-organosilane-coated substrates was evaluated, by way of example, on samples comprising an aluminum film on a flexible polyimide substrate. Both monomeric and oligomeric amino-organosilanes from the list above were evaluated. Several samples were cleaned using an oxygen plasma (100 sccm $O_2$, 100 W, 50 mTorr, 1 min.) to remove any organic contaminates and create a thin oxide layer on the aluminum surface. The samples were immersed for 2.5 minutes in aqueous dispersions containing 0.1% reactive amino-organosilane from the list provided above at a specific pH and temperature. The pH was adjusted with acetic acid. For example, the evaluation included samples at pH 4 and temperature of about 40° C.; two samples groups at pH 7-8, one at a temperature of about 20° C. and one at a temperature of about 40° C.; and samples at greater than pH 9 (i.e., pH>9) and a temperature of about 40° C. The coatings were baked at about 120° C. for 20 minutes to eliminate any adsorbed water and to enhance organosilane crosslinking. A control sample did not receive an amino-organosilane coating. After two to three days, a polymer-based pattern mask was printed on the samples using a liquid toner material and a sheet fed HP Indigo 5000 press. The pattern mask comprised about 100 micron wide lines on about 1 mm centers with 2 layers of a cyan HP Indigo Electrolnk.

The adhesion of the pattern mask was evaluated using a mechanical peel-off test and measured by an amount of the pattern mask material removed from the surface. A super strong adhesive tape, for example 3M Premium Heavy Duty Packaging Tape No. 3750, from 3M, Inc., Minnesota, was used. The tape was applied on the surface immediately after printing with a 2 kg roller and peeled gently in a continuous fashion. The pattern mask adhered well to all amino-organosilane coated samples in that at least a majority of the pattern mask material remained adhered to the substrate surface of the samples. By comparison, on the control sample having no amino-organosilane coating, the peel-off test removed all of the printed pattern mask material from the substrate surface.

Adhesion of the pattern mask was excellent on all of the amino-organosilane coatings that were deposited at a pH>9 (i.e., no pattern mask was removed during peel-off). This may be due to greater coverage from a higher organosilane condensation reaction rate with the surface at pH>9, for example. Moreover, amino-organosilane coatings deposited from solutions at about 40° C. had better adhesion properties when compared to the same coatings deposited from solution at room temperature (about 20° C.). Such a result could be due to increased solubility of the organosilane in the bulk solution, for example. Moreover, the monomeric and oligomeric amino-organosilane coatings (i.e., Gelest SIA0590.0 and WSA-9911) performed better at enhancing adhesion of the pattern mask material than the corresponding copolymeric amino-organosilane coatings, which comprise a methylsilsequioxane 'spacer' (i.e., Gelest WSA-7021 and WSA-7011, respectively). The spacer had an unfavorable effect on the adhesion of the coating at pH 7-8, which may be due to a reduction in a relative amount of amines available for hydrogen bonding, for example. Moreover, the presence of two amine groups (i.e., primary and secondary) in the monomeric amino-organosilane coating (i.e., Gelest SIA0590.0) enhanced the adhesion of the pattern mask material relative to the single amine group coatings (i.e., Gelest WSA-9911 and WSA-7011). The two amine groups may increase an amount of hydrogen bonding with the pattern mask material relative to one amine group, for example.

As such, under the same pH and temperature conditions, a monomeric diamine organosilane performed better than an oligomeric amine organosilane at enhancing adhesion of the polymer-based pattern mask to an aluminum substrate surface. The oligomeric amine organosilane performed better than a copolymeric diamine organosilane. Moreover, the copolymeric diamine organosilane performed better than a copolymeric amine organosilane. With respect to the four Gelest amino-organosilanes tested as coatings, the adhesion enhancement performance followed a trend of SIA0590.0>WSA-9911>WSA-7021>WSA-7011.

The method 100 of masking a substrate is applicable to patterning the substrate using either pattern etching or pattern lift-off after the pattern mask is printed 120. For example, wet etching may be employed to etch a metal film on a surface of the substrate using the liquid toner pattern mask to guide the etching. Referring to the exemplary aluminum-clad substrate discussed above, a commercially available acidic wet etchant may be employed to pattern aluminum film protected by the liquid toner pattern mask, according to various embodiments. An example of an acidic wet etchant for aluminum is AL-12S marketed by Cyantek, Fremont, Calif. AL-12S comprises 74% phosphoric acid, 10% acetic acid, 2% nitric acid, 14% water and 1% surfactant.

Figure 2:
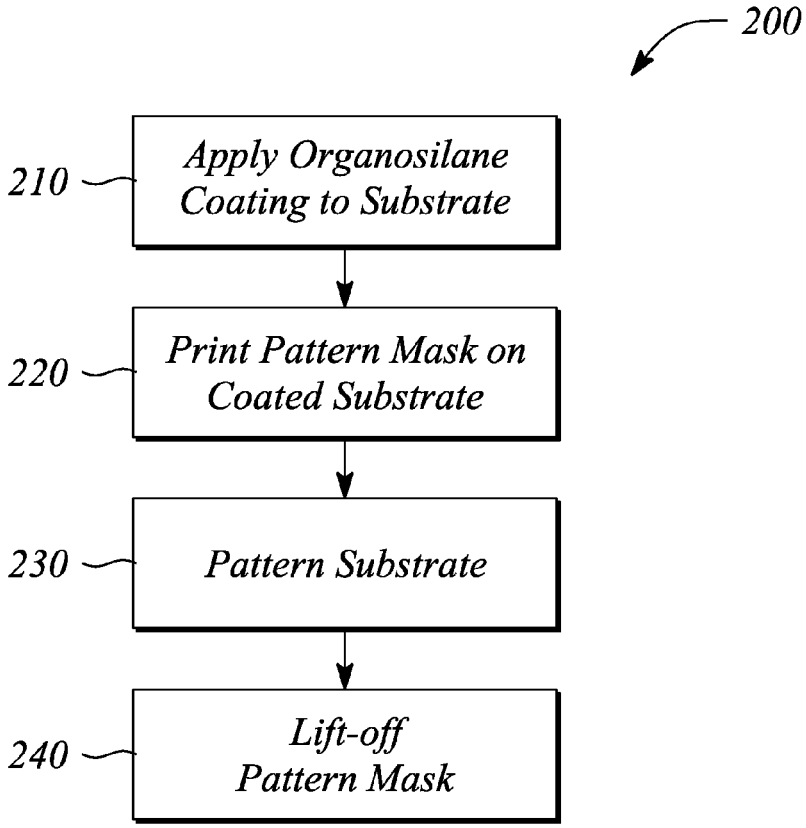
FIG. 2 illustrates a flow chart of a method of patterning a substrate according to an embodiment of the present invention.

FIG. 2 illustrates a flow chart of a method 200 of patterning a substrate according to an embodiment of the present invention. As defined above, the term substrate means one or more of a compatible substrate itself and a layer or layers of a compatible material on a surface of a substrate, excluding the organosilane coating. Thus, the method 200 of patterning is applicable to patterning a single cladding layer as well a multiple cladding layers of a compatible material (e.g., single or multiple thin films of one or more of a metal, a semiconductor and a dielectric) on one or more surfaces of a substrate, according to some embodiments. The method 200 of patterning is also applicable to patterning a compatible substrate material itself, according to some embodiments. For example, the substrate may comprise a sheet of material that is coated or clad on one or both of a front surface and a back surface with a compatible metal film or foil. The exemplary substrate material may comprise a flexible polyimide sheet and an exemplary metal film or foil to be patterned may comprise aluminum, for example, on the front surface. A stainless steel film may be applied on a back surface of the flexible polyimide sheet to facilitate printing (e.g., to avoid substrate charging during printing). The method 200 of patterning defines a pattern in one or both of the metal foil claddings on the substrate, in this example.

In some embodiments, after the metal foil is patterned, a subsequent layer of material to be patterned may be applied to the patterned metal foil layer in a process to fabricate a multilayer printed circuit. The method 200 of patterning may be repeated for each layer of material to be patterned that is subsequently applied for the multilayer printed circuit.

The method 200 of patterning a substrate comprises applying 210 a coating of an organosilane on a surface of a substrate to be patterned; and printing 220 a pattern mask on the substrate surface using a roll-to-roll printing process. The substrate surface comprises a material compatible to the organosilane. In some embodiments, applying the organosilane coating and printing a pattern mask are the same as that described above with respect to the method 100 of masking. In some embodiments, the organosilane is a water-borne amino-organosilane that is applied 210 from an aqueous media. In other embodiments, the organosilane is a non-hydrolyzed amino-organosilane that is applied 210 from a non-aqueous media, such as an alcohol. The organosilane is applied using a deposition technique including, but not limited to, one or more of immersion, spray, ink jet, gravure and vapor phase deposition. In some embodiments, the pattern mask comprises a polymer-based liquid toner that is fused on a surface of the substrate during printing. The polymer-based liquid toner is described above with respect to the method 100 of masking and explicitly includes, but is not limited to, HP Electrolnk liquid toner. In some embodiments, the roll-to-roll printing process comprises offset liquid electrophotographic (LEP) printing.

In some embodiments, printing 220 a pattern mask comprises printing a liquid toner pattern mask onto a flexible substrate using LEP printing. The flexible substrate comprises one of a flexible sheet and a flexible web, and a compatible metal film affixed to one or both of a top surface and a bottom surface of the flexible sheet or web.

The method 200 of patterning further comprises patterning 230 the substrate. Patterning 230 the substrate may comprise one or both of pattern etching and pattern lift-off, depending on the embodiment, and employs the printed 220 pattern mask. In some embodiments, patterning 230 the substrate comprises etching one or both of the substrate and a compatible material layer(s) (e.g., the metal foil) on a surface of the substrate. For example, patterning 230 the substrate by etching may comprise exposing the aforementioned exemplary aluminum clad polyimide substrate to an acid etchant such as, but not limited to, AL-12 S. The etchant preferentially attacks and removes the aluminum that is exposed by the pattern mask. The aluminum covered by the pattern mask is protected from the etchant and is not etched. The removal of the exposed aluminum effectively patterns 220 the aluminum cladding on the polyimide substrate. The organosilane coating that enhances adhesion between the pattern mask and the substrate surface during printing also enhances the adhesion between the pattern mask and the substrate during the etching process and therefore, the pattern mask remains intact during pattern etching or patterning.

The method 200 of patterning a substrate further comprises lifting-off 240 the pattern mask from the patterned 230 substrate. Lifting-off 240 the pattern mask is essentially similar to removing the pattern mask described above with respect to the method 100 of masking a substrate. In some embodiments, lifting-off 240 the pattern mask comprises exposing the patterned substrate to a lift-off solution having a basic pH such that a bond between the substrate and the pattern mask is broken. The organosilane coating that enhances adhesion between the pattern mask and the substrate surface during printing and patterning does not interfere with breaking the bonds between the pattern mask and the substrate during lifting-off 240 the pattern mask with the lift-off solution at the basic pH.

In some embodiments, the lifting-off solution comprises TMAH. In some embodiments, the lifting-off solution further comprises silicic acid. The silicic acid acts as a passivating agent, as further described above with respect to the method 100 of masking a substrate. For example, the silicic acid passivates an exposed surface of the exemplary aluminum cladding on the polyimide substrate to protect the exposed, organosilane-coated aluminum cladding from any corrosive effect of the TMAH agent in the lifting-off solution.

In some embodiments, the method 200 of patterning further comprises pre-treating the substrate prior to applying 210 the organosilane coating. In some embodiments, the substrate is pre-treated using RIE plasma to remove organic contaminants, such as the plasma cleaning described above for the method 100 of masking. In some embodiments, the substrate is pre-treated to oxidize a surface of the substrate, such that sufficient hydroxyl functionality is provided to the substrate surface for bonding with the organosilane coating, also described above for the method 100 of masking.

Figure 3:
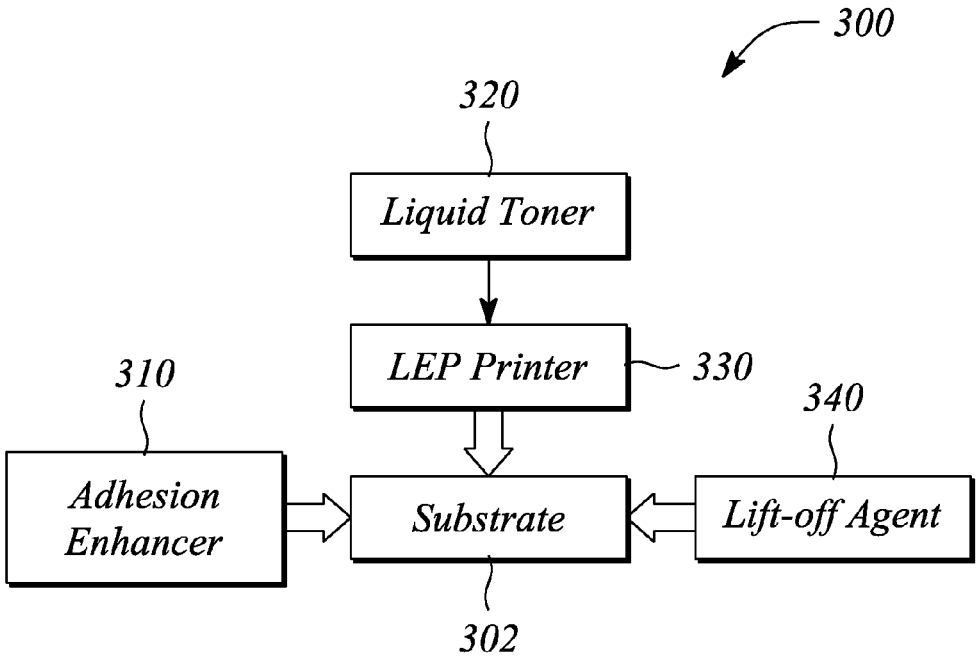
FIG. 3 illustrates a block diagram of a polymer-based pattern mask system according to an embodiment of the present invention.

FIG. 3 illustrates a block diagram of a polymer-based pattern mask system 300 according to an embodiment of the present invention. The polymer-based pattern mask system 300 (i.e., 'system 300') is employed to pattern a substrate 302. The system 300 is useful in roll-to-roll processing of large scale flexible circuits. In various embodiments, patterning the substrate 302 using the system 300 comprises one or more of pattern etching and pattern lift-off.

The polymer-based pattern mask system 300 comprises an adhesion enhancer 310 that is applied to the substrate 302 surface. The adhesion enhancer 310 is an amino-organosilane coating that is applied to the substrate as a very thin layer or film (i.e., one or more molecular layers). A surface of the substrate 302 comprises a stable oxide such that it is compatible with the organosilane coating. The system 300 further comprises a polymer-based pattern mask 320. In some embodiments, the polymer-based pattern mask 320 is applied to the substrate surface using a roll-to-roll printing process. In some embodiments, the polymer-based pattern mask system 300 further comprises a liquid electrophotographic (LEP) printer 330 that includes the roll-to-roll process. The pattern mask 320 is applied to the surface of the substrate 302 by the LEP printer 330 for use in patterning the substrate 302.

The polymer-based pattern mask 320 adheres better to the substrate surface with the adhesion enhancer 310 coating than without the adhesion enhancer 310 coating. The adhesion enhancer 310 is applied to the substrate using a deposition process compatible with roll-to-roll processing prior to printing the pattern mask 320. In some embodiments, the adhesion enhancer 310 is applied using one or more of immersion, spray, ink jet and vapor phase deposition. In some embodiments, the adhesion enhancer 310 is applied using an immersion roll-to-roll process. The adhesion enhancer 310 and its application are similar to any of the embodiments described above for the method 100 of masking and the method 200 of patterning.

In some embodiments, the polymer-based pattern mask 320 is a liquid toner that comprises a carrier liquid and toner particles dispersed in the carrier liquid. The toner particles comprise a polymer. The polymer comprises a polymer blend, in some embodiments. The liquid toner is applied to the surface of the substrate 302 by the LEP printer 330 to produce the polymer-based pattern mask 320. The liquid toner and the polymer-based pattern mask 320 are similar to the liquid toner pattern mask embodiments described above for the method 100 of masking and the method 200 of patterning. For example, the liquid toner may be any of the liquid toners described above including, but not limited to, HP Electrolnk. Similarly, the LEP printer 330 may be either a web-fed press or a sheet-fed press including, but not limited to, any of an HP Indigo press ws4050, HP Indigo press ws4500, and an HP Indigo press 5000 series printer.

The polymer-based pattern mask system 300 further comprises a lift-off agent 340. The lift-off agent 340 degrades a bond between the applied pattern mask 320 and the substrate 302 surface. The adhesion enhancer 310 does not impede the action of the lift-off agent 340. The adhesion enhancer 310 improves adhesion between the pattern mask 320 and the substrate 302 during printing and patterning, as described above for the methods 100 and 200. The lift-off agent 340 facilitates removal of the pattern mask 320 following substrate patterning and, in some embodiments, further facilitates patterning. Specifically, the lift-off agent 340 is applied to the substrate 302 either after patterning (e.g., pattern etching) to remove the pattern mask (i.e., mask lift-off) or during patterning (e.g., pattern lift-off) to both remove the pattern mask and concomitantly facilitate patterning. In various embodiments, the lift-off agent 340 is essentially similar to any of the embodiments of the lift-off agent or lift-off solution described above for the method 100 of masking a substrate and the method 200 of patterning a substrate. For example, the lift-off agent 340 may comprise TMAH. In some embodiments, the lift-off agent 340 further comprises a passivating agent such as, but not limited to, silicic acid.

The organosilane adhesion enhancer has one or more characteristics compatible with fabrication of flexible printed electronics using lithography. For example, the organosilane adhesion enhancer is applied through simple coating techniques which are compatible with roll-to-roll processes. The water-borne organosilanes are stable in aqueous solutions. The organosilanes are environmentally friendly. The operating costs to use the organosilane are negligible, for example, the amount of organosilane for a targeted coverage is very small. The organosilane adhesion enhancer may be applicable to the fabrication of flexible printed electronics through subtractive processes for one or more of displays, printed circuit boards, interconnects for flexible solar cells and commercial or industrial printing of metallized packaging materials and protective coatings. Moreover, the organosilane adhesion enhancer may be used with other roll-to-roll etch mask printing systems, for example in self-aligned imprint lithography (SAIL), where improved adhesion is targeted for polymers with metals, for example, in the fabrication of large inexpensive flexible electronics.

Thus, there have been described embodiments of a method of masking a substrate, a method of patterning a substrate, and a mask system that employ an organosilane coating to enhance adhesion between a polymer-based pattern mask and a substrate. It should be understood that the above-described embodiments are merely illustrative of some of the many specific embodiments that represent the principles of the present invention. Clearly, those skilled in the art can readily devise numerous other arrangements without departing from the scope of the present invention as defined by the following claims.

What is claimed is:

1. A method of masking a substrate, the method comprising:

applying a coating of an organosilane to a surface of a substrate to be patterned, the substrate surface comprising a material compatible with the organosilane; and printing a pattern mask on the coated substrate using liquid electrophotographic (LEP) printing, the pattern mask comprising a fused liquid toner, the liquid toner comprising toner particles dispersed in a carrier liquid, the toner particles comprising a polymer resin, wherein the organosilane enhances adhesion between the substrate surface and the pattern mask during LEP printing.

2. The method of masking a substrate of claim 1, wherein the organosilane is a water-borne aminoalkyl-organosilane selected from one of an aminoethyl-aminopropyl-silanetriol monomer, a copolymer of an aminoethyl-aminopropyl-silsesquioxane and an alkyl-silsesquioxane, a copolymer of an aminopropyl-silsesquioxane and an alkyl-silsesquioxane, and an aminopropyl-silsesquioxane oligomer.

3. The method of masking a substrate of claim 1, wherein the organosilane is a water-borne N-(2-aminoethyl)-3-aminopropyl-silanetriol.

4. The method of masking a substrate of claim 1, wherein the organosilane is a water-borne aminopropyl-silsesquioxane.

5. The method of masking a substrate of claim 1, wherein the organosilane is a water-borne aminoalkyl-silsesquioxane copolymer comprising 65 percent to 75 percent of either N-(2-aminoethyl)-3-aminopropyl-silsesquioxane or aminopropyl-silsesquioxane and a corresponding 25 percent to 35 percent methyl-silsesquioxane.

6. The method of masking a substrate of claim 1, wherein the organosilane is a non-hydrolyzed aminoalkyl-organosilane selected from N-(2-aminoethyl)-3-aminopropyl-trimethoxysilane and N-(2-aminoethyl)-3-aminopropyl-triethoxysilane.

7. The method of masking a substrate of claim 1, wherein the substrate comprises a flexible material and a metal film to be patterned, the metal film being on a surface of the flexible material, the metal film being compatible with the organosilane coating, the organosilane coating facilitating adhesion of the pattern mask to the metal film.

8. The method of masking a substrate of claim 1, wherein printing a pattern mask comprises using an offset LEP printer that comprises either a web-fed press or a sheet-fed press, the offset LEP printer using roll-to-roll processing, the adhesion of the pattern mask to the substrate surface is enhanced for winding and rewinding the substrate during the LEP roll-to-roll processing.

9. The method of masking a substrate of claim 1, wherein applying a coating of an organosilane comprises dispersing the organosilane in an aqueous solution, the organosilane being a water-borne amino-organosilane; adjusting a pH of the organosilane solution; depositing the organosilane solution on the substrate; and drying the organosilane solution to form the organosilane coating on the substrate surface.

10. The method of masking a substrate of claim 1 employed in patterning the substrate using the pattern mask, wherein adhesion of the pattern mask to the substrate surface is further enhanced during patterning by the organosilane, and wherein the pattern mask is removed after patterning, removing the pattern mask comprising using a lift-off agent having a basic pH to break a bond between the substrate surface and the pattern mask, wherein removing the pattern mask is unhindered by the organosilane.

11. A method of patterning a substrate, the method comprising:

applying a coating of an organosilane to a surface of a substrate to be patterned, the substrate surface comprising a material compatible with the organosilane;

printing a pattern mask on the coated substrate surface using a roll-to-roll printing process, the pattern mask being polymer-based, the organosilane forming a bond between the pattern mask and the substrate surface;

patterning the substrate surface using the pattern mask; and lifting-off the pattern mask from the patterned substrate surface, wherein the organosilane enhances adhesion between the substrate surface and the pattern mask during printing and patterning, and wherein lifting-off the pattern mask is unhindered by the organosilane.

12. The method of patterning a substrate of claim 11, wherein the pattern mask comprises a fused liquid toner that is deposited on the substrate surface in a predetermined pattern during printing, the liquid toner comprising toner particles dispersed in a carrier liquid, the toner particles comprising a polymer resin, wherein printing comprises evaporating the carrier liquid and fusing the toner particles together, the roll-to-roll printing process comprising a liquid electrophotographic (LEP) printing process.

13. The method of patterning a substrate of claim 11, wherein the substrate is a flexible sheet having a metal film to be patterned on the surface, the surface being one or both of a front side and a back side of the flexible sheet, the metal film being compatible with the organosilane.

14. The method of patterning a substrate of claim 11, wherein the substrate surface comprises an aluminum film, the organosilane comprising a water-borne aminoalkyl-organosilane, and wherein applying a coating of an organosilane comprises:

adjusting a pH of an aqueous solution comprising the organosilane to within a range of pH 7 and pH 8;

depositing the solution on the aluminum film; and drying the deposited solution to form the organosilane coating on the aluminum film, and wherein lifting-off the pattern mask comprises exposing the patterned aluminum film to an aqueous solution at a basic pH that comprises tetramethyl ammonium hydroxide (TMAH) and silicic acid.

15. The method of patterning a substrate of claim 11, wherein applying a coating comprises depositing on the substrate a water-borne aminoalkyl-organosilane dispersed in an aqueous solution at a pH greater than or equal to pH 9; and drying the solution to form the organosilane coating on the substrate surface, wherein printing a pattern mask comprises using an offset liquid electrophotographic (LEP) printer, the pattern mask comprising a fused polymer-based liquid toner, wherein patterning the substrate comprising pattern etching the substrate surface, and wherein lifting-off the pattern mask comprises using an aqueous solution that comprises tetramethyl ammonium hydroxide (TMAH) at a basic pH.

16. The method of patterning a substrate of claim 11, wherein the organosilane is either a water-borne aminoalkyl-organosilane selected from one of an aminoethyl-aminopropyl-silanetriol monomer, a copolymer of an aminoethyl-aminopropyl-silsesquioxane and an alkyl-silsesquioxane, a copolymer of an aminopropyl-silsesquioxane and an alkyl-silsesquioxane, and an aminopropyl-silsesquioxane oligomer or a non-hydrolyzed aminoalkyl-organosilane selected from an aminoalkyl-trialkoxysilane.

17. A polymer-based pattern mask system comprising:

a polymer-based liquid toner, the liquid toner acting as a pattern mask when printed on a substrate, the pattern mask being employed in patterning a surface of the substrate;

an organosilane, the organosilane being coated on the surface of the substrate, the substrate surface to be patterned comprising a material compatible with the organosilane, the organosilane coating enhancing adhesion between the pattern mask and the substrate surface; and a lift-off agent that degrades a bond between the substrate and the pattern mask to facilitate removal of the pattern mask after substrate patterning, wherein the organosilane coating enhances adhesion during patterning of the substrate surface, while removal of the pattern mask is unhindered by the organosilane coating.

18. The polymer-based pattern mask system of claim 17, further comprising a liquid electrophotographic (LEP) printer to print a patterned liquid toner on the substrate as the pattern mask using a roll-to-roll process, wherein the organosilane coating further enhances adhesion of the pattern mask to the substrate during the roll-to-roll printing process.

19. The polymer-based pattern mask system of claim 17, wherein the polymer-based liquid toner comprises a carrier liquid and toner particles dispersed in the carrier liquid, the toner particles comprising one of a polymer and a polymer blend, the polymer blend comprising a mixture of polymers and copolymers, and wherein the lift-off agent is a solution comprising tetramethyl ammonium hydroxide (TMAH) having a basic pH.

20. The polymer-based pattern mask system of claim 17, wherein the organosilane is either a water-borne aminoalkyl-organosilane selected from N-(2-aminoethyl)-3-aminopropyl-silanetriol, N-(2-aminoethyl)-3-aminopropyl-silsesquioxane and methyl-silsesquioxane copolymer, an aminopropyl-silsesquioxane and a methyl-silsesquioxane copolymer, and an aminopropyl-silsesquioxane or a non-hydrolyzed aminoalkyl-organosilane selected from N-(2-aminoethyl)-3-aminopropyl-trimethoxysilane and N-(2-aminoethyl)-3-aminopropyl-triethoxysilane.

* * * * *